United States Patent [19]

Kellogg

[11] Patent Number: 4,887,537

[45] Date of Patent: Dec. 19, 1989

[54] SHOCK RESISTANT STORAGE BIN AND PALLET ASSEMBLY

[75] Inventor: George E. Kellogg, Kettering, Ohio

[73] Assignee: General Motors Corporation, Detroit, Mich.

[21] Appl. No.: 697,971

[22] Filed: Feb. 4, 1985

[51] Int. Cl.[4] ..... B65D 19/44

[52] U.S. Cl. ..... 108/55.1; 108/55.3

[58] Field of Search ..... 108/55.1, 55.3, 55.5, 108/56.1

[56] References Cited

U.S. PATENT DOCUMENTS

| | | | |
|---|---|---|---|
| 3,621,797 | 11/1971 | Hunter | 108/55.3 |
| 3,628,468 | 12/1971 | Angelbeck | 108/55.3 |
| 3,654,875 | 4/1972 | Vik | 108/55.3 |
| 4,013,020 | 3/1977 | Schoeller | 108/55.3 |
| 4,453,471 | 6/1984 | Harrington et al. | 108/55.1 |

*Primary Examiner*—Francis K. Zugel

*Attorney, Agent, or Firm*—D. D. McGraw

[57] ABSTRACT

A storage container such as a bin or tank is received on a pallet having a shock isolation arrangement which will reduce damage to the container and the goods contained therein. The pallet is formed with a hollow square frame having rolled or otherwise formed edges arranged to retain rubber-like hose sections which engage the container sides adjacent each container corner and absorb horizontal plane shock as well as some vertical plane shock. Once the rubber hose sections are inserted in the pallet frame while the container is in position thereon, the sections will hold the frame and the container together so that they may be transported as a unitary assembly. The rubber-like hoses will continue to isolate the container from impacts transmitted to the pallet in typical handling operations. The assembly may be readily moved by a forklift or other similar equipment.

5 Claims, 1 Drawing Sheet

SHOCK RESISTANT STORAGE BIN AND PALLET ASSEMBLY

The invention relates to a pallet assembly with a storage container or bin mounted thereon and resiliently secured to the pallet by resilient members such as sections of hose which also act as shock absorbers to minimize impact shocks transmitted to the material contained in the bin or container when the assembly is being handled or is bumped. More particularly, it relates to a storage container and pallet assembly in which the pallet supports the storage container for transport by a forklift of the like engageable with the bottom portion of the pallet, and resilient means removably engaging the storage container and the pallet and locking them together to form the entire assembly. The resilient removable means has shock absorbent capability and isolates the storage container from impact shocks in a generally horizontal plane which may be imparted to the pallet during handling or otherwize. The pallet is a hollow frame having rolled or otherwise formed edges arranged to retain rubber-like hose sections which engage the container sides in spaced relation around the container and absorb substantially horizontally directed impact shocks. Once the rubber hose sections are inserted in the pallet frame while the container is in position on the frame, they will hold the frame and the container together. For this purpose the container has a retention flange or ledge which is also engaged by the hose sections. In a typical arrangement the container and the pallet are rectangular and the rubber hose sections are fitted at the corners. The pallet frame raised edges are discontinuous to provide entry gaps so that the hose sections may be readily removed and inserted when it is desired to separate the containers from the pallet and then later reinstall the container back on the pallet.

IN THE DRAWING

Figure 1:
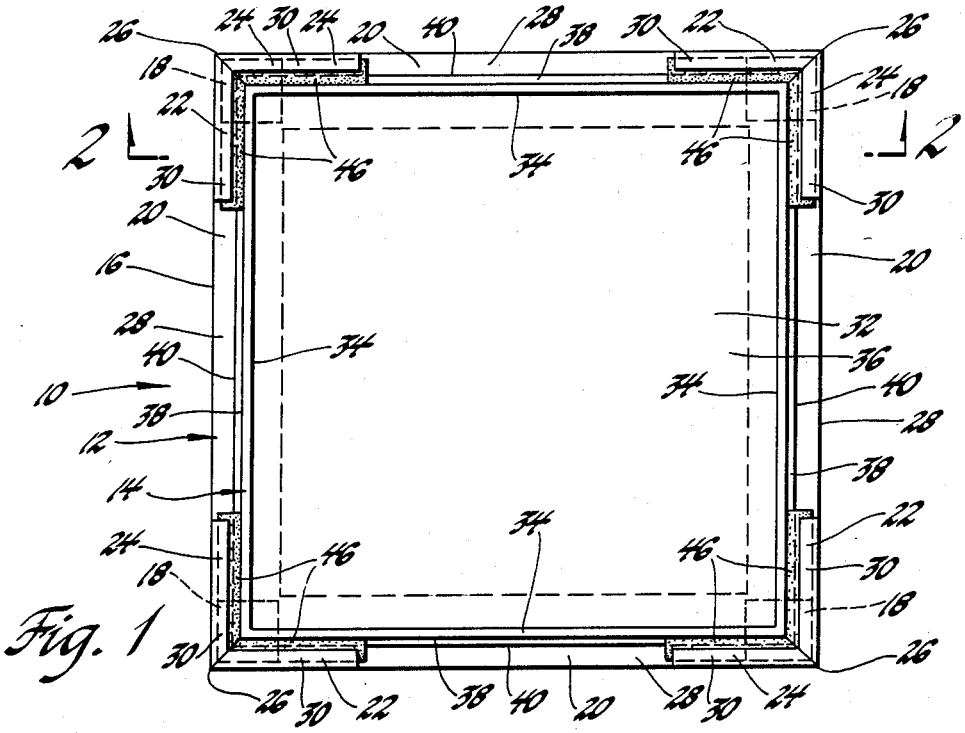
FIG. 1 is a plan view of a container and pallet assembly embodying the invention.

The storage container and pallet assembly 10 includes a pallet 12 supporting a container 14 thereon. The pallet has a substantially horizontal frame 16 and is illustrated as being rectangular in form. The frame has legs 18 secured thereto at each corner to support the frame in a raised position when it is sitting on a floor or other substantially level surface. The legs are so positioned that they provide horizontal and vertical clearance under the frame for suitable lifting and transporting means such as the forks of a forklift to extend thereunder and lift the entire assembly and any goods contained in the container. The frame 16 is illustrated as being made up of four frame sections 20, each frame section forming one side of the rectangular frame 16. At each corner of the frame there is a lip or flange 22 on one end of each frame section 20 and a similar lip or flange 24 on the other end of each frame section 20. Each lip or flange 22 mates with a lip or flange 24 at a corner 26, as best seen in FIG. 1. Each lip or flange extends along only a portion of its frame section so that there is a discontinuous section 28, which is preferably somewhat longer than each lip or flange 22 or 24.

Figure 2:
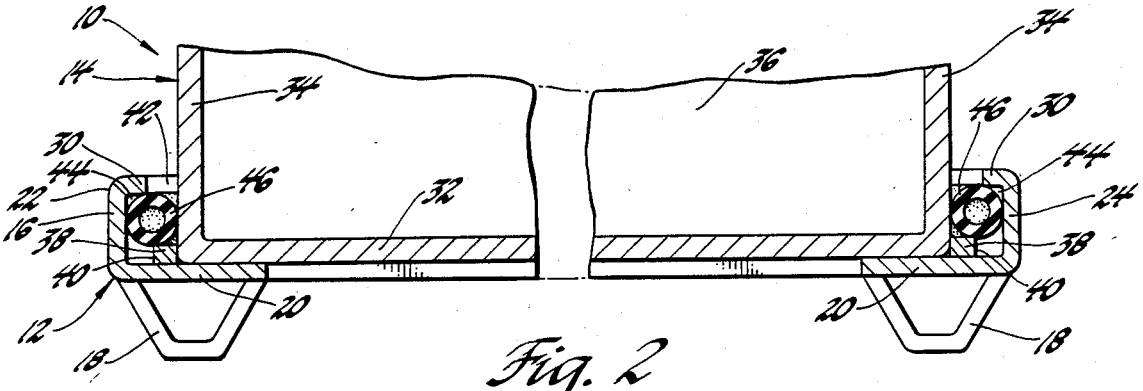
FIG. 2 is a fragmentary cross-section view of the assembly of FIG. 1, with parts broken away, and taken in the direction of arrows 2—2 of that Figure.

As shown in FIG. 1 there are four such discontinuous sections 28. Each discontinuous section 28 forms an entry gap or space for purposes described below. As shown in FIG. 2, each lip or flange 22 and 24 is generally channel-shaped with its upper edge being bent inwardly so that the lip edge or end 30 extends toward the interior of the frame and is positioned vertically above the outer portion of the frame section on which the lip or flange is formed. In the arrangement shown in FIG. 3, each lip or flange 122 and 124 has a portion extending vertically upward from its associated frame section 20 and then extending outwardly in a generally semi-circular or rolled fashion as seen in cross section so that the upper end 130 of each lip or flange extends toward the interior of the frame.

The storage container or bin 14 may be any of several types depending upon the type of goods to be contained therein. It may be a solid container with an open top, of the type illustrated in the drawing, in which it has a bottom 32 and side walls 34 extending upwardly to define with the bottom the interior 36 of the container. In some instances the container may be a tank for the storage of liquids and may have a closed top. In other instances it may be made of an expanded metal construction with appropriate framing. Whatever its construction, it is arranged to be able to store goods therein and to be used for transport of the goods. The container is provided with a retention flange 38 which extends outwardly of the container adjacent the container bottom 32. As shown in FIGS. 1 and 2, the retention flange or ledge 38 is formed to provide a lower lip extending around the bottom of the container and suitably secured thereto. For example, it may be welded to the container bottom or side walls. As illustrated in the drawing, the retention flange 38 may extend entirely around the outside of the container 14. However, it may be discontinuous if desired so long as it extends at least in the area of each of the pallet flanges 22 and 24. The retention flange 38 has an outer edge 40 facing laterally outward from container 14 and so arranged in relation to the end 30 of the lip flanges 22 and 24 as to be able to fit vertically through the clearances 42 established by each lip flange end 30 and the adjacent side wall 34 of the container. Thus the container with its retention flange 38 may be lowered vertically onto the pallet with the retention flange 38 passing through the clearance spaces 42. The retention flange 38 is then contained within the spaces defined by the lip flanges 22 and 24 and is positioned vertically lower than the lip ends 30 to define with each lip flange a keyway or lock channel space 44, which may be considered to be a tunnel-like space, as is particularly illustrated in FIG. 2. Each space 44 extends substantially horizontally about the portions of the container where lip flanges 22 and 24 are located.

Resilient retainer or securing members 46 are provided and are preferably formed as resilient hose-like members. They may actually be segments of some types of garden hose, for example. Members 46 are flexible and provide locking and shock absorbing functions when installed. The spaces 44 and the resilient retainers 46 are so sized relative to each other that the retainers may be inserted lengthwise into the spaces 44 from the discontinuous sections 28 providing entry gaps for the retainers, as above described. When so installed, they substantially surround the container 14 in shock absorbing resilient engaging relation with the container and with the pallet lip flanges 22 and 24. They sufficiently fill the keyway spaces 44 to cooperate with the lip flanges 22 and 24 and the container retention flanges or ledges 38 to resiliently but positively lock the pallet 12 and the container 14 together to provide a transportable storage mechanism. Members 46 are also so arranged that they isolate the container from horizontal impact shocks due to their resilient shock absorbing characteristics. Such shocks are commonly imparted to the pallet during movement when the pallet is bumped into other devices, posts, etc.

Figure 3:
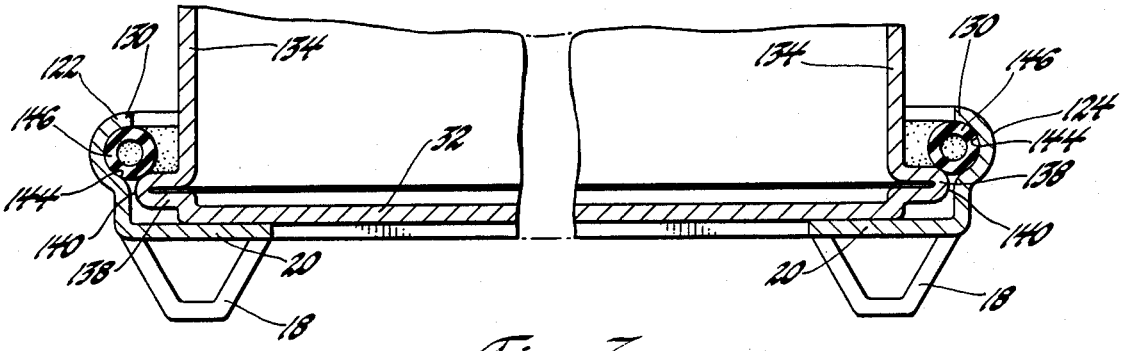
FIG. 3 is a fragmentary cross-section view similar to that of FIG. 2 but showing a modified construction.

The modified embodiment of FIG. 3 shows the retention flanges 138 being integrally formed as a part of the container side walls 134, with their ends 140 also vertically clearing the ends 130 of the lip flanges 122 and 124. The resilient retainers 146 are sized relative to the keyway spaces 144 formed by lip flanges 122 and 124 and retention flanges 138 so that they substantially fill the spaces 144 and engage the semi-circumferential portion of each lip flange 122 and 124 as well as the integrally formed retention flange 138 of the container. The assembly of FIG. 3 functions in the same manner as the assembly of FIGS. 1 and 2.

It can be seen that the container 14 may be readily removed from the pallet 12 by first removing the resilient retainers 46 and then lifting the container vertically until it is clear of the lip flanges 22 and 24 or 122 and 124. Similarly, the container may be vertically lowered onto the pallet and the resilient retainers installed as shown to secure the pallet and container together and provide the resilient shock absorbent characteristics described above. It is also noted that the resilient retainers 46 will provide some vertical shock absorption when the pallet tends to be separated from the container as the container is lifted vertically without the resilient retainers having been removed. In some instances, it is desirable to transport the entire assembly with the goods contained therein while the pallet is still secured to the container. Thus the vertical shock absorbing action may be of benefit while such an operation is taking place.

It is recognized that other container and pallet shapes may be provided if necessary, it being of primary importance that the resilient retainers have the same type of relationship with the pallet and the container so as to resist the various shock loads. In some instances, for example, it may be desirable to reverse the positions of the lip flanges and the discontinuous sections to provide the flanges on each side of the container and pallet rather than at each corner. The arrangement may also be used for other shaped containers, which may be circular, for example.

The embodiments of the invention in which an exclusive property or privilege is claimed are defined as follows:

1. A transportable storage mechanism having a pallet and a storage device mounted on said pallet and shock absorbent means resiliently securing said pallet and said storage device together to isolate said storage device from transport impact by absorbing horizontal plane shock, said mechanism more specifically comprising:

said storage device having a substantially horizontal bottom and side means defined by panel means secured to said bottom and extending upwardly therefrom to form a container in which goods may be stored and transported, and flange-like retention means extending outwardly of said container adjacent said bottom;

said pallet having a substantially horizontal frame section receiving said container bottom thereon in supporting relation, leg means appropriately spaced on the underside of said frame section and supporting said frame section and said container in a raised position, said leg means providing horizontal and vertical clearance under said frame section for suitable lifting and transporting means such as the forks of a forklift to extend thereunder and lift said storage mechanism and any goods therein, said pallet further having raised lip-like means formed on said frame section and extending in spaced relation about said container horizontally above said retention means but vertically clear thereof so as to permit said container to be moved vertically onto and from said pallet when said shock absorbent resilient securing means are not in place, said lip-like means cooperating with said retention means to define keyway-like space means extending substantially horizontally about said container;

said shock absorbent resilient securing means being resilient key means received in said keyway-like space means after said container is placed on said pallet frame section in supporting relation, said shock absorbent resilient securing means substantially surrounding said container in shock absorbing resilient engaging relation with said container and said pallet raised lip-like means and sufficiently filling said keyway-like space means to cooperate with said lip-like means and said flange-like retention means to resiliently but positively lock said pallet and said container together to provide the transportable storage mechanism;

said lip-like means having at least one discontinuous section permitting insertion and removal of said shock absorbent resilient securing means.

2. A storage container and pallet assembly having a shock isolation arrangement for protecting and reducing damage to said container, said assembly comprising:

a storage container having a substantially horizontal bottom section and substantially vertical side sections cooperating to define a generally rectangular container adapted to hold goods to be stored and to be moved and transported by machines such as forklifts and the like, said rectangular storage container having retaining ledge means extending generally horizontally outward therefrom in the vicinity of said bottom wall, said retaining ledge means being located at least on either side of and adjacent to each corner of said container;

a pallet formed as a rectangular frame having pallet support means extending downwardly from the underside thereof to support said frame with sufficient clearance to accommodate the forks of a forklift and the like, said pallet further having upwardly extending flange means at each corner of said rectangular frame with the upper edges thereof extending inwardly of said frame, said flange means being discontinuous about said frame to provide at least one entry gap between at least two of the corners of said frame;

said storage container being received on said pallet with its bottom section supported by said frame within said upwardly extending flange means, said storage container retaining ledge means and said flange means being so aligned as to cooperatively provide lock channel means defined by said container side wall sections, said retaining ledge means and said flange means, said flange means inwardly extending upper edges being higher than said retaining ledge means;

and resilient flexible locking and shock absorbing members formed into lengths which are inserted through said at least one entry gap and received in said lock channel means and engaging said pallet and said container adjacent each corner, said members absorbing horizontal plane shock and locking said container and said pallet together into an assembly, said members being removable through said at least one entry gap for replacement and to separate said container and said pallet.

3. A storage container and pallet assembly comprising:

a storage container;

a pallet supporting said storage container for transport by a forklift or the like;

lower lip means on said container and upper lip means on said pallet defining with said container and said pallet a series of substantially horizontally spaced tunnel-like spaces positioned about said container and having access ends;

and lengths of resilient hose-like members removably received in said tunnel-like spaces and resiliently engaging said storage container and said pallet and locking them together to form said assembly, said hose-like members having shock absorbent capability and isolating said storage container from impact shocks which may be imparted to said pallet;

said lengths of resilient hose-like members being inserted in said tunnel-like spaces through said access ends for replacement and for separation of said container and said pallet.

4. A transportable storage mechanism having a pallet and a storage device mounted on said pallet and shock absorbent means resiliently securing said pallet and said storage device together to isolate said storage device from transport impact by absorbing impact shocks imparted to said pallet, said mechanism more specifically comprising:

said storage device having a substantially horizontal bottom and side means defined by panel means secured to said bottom and extending upwardly therefrom to form a container in which goods may be stored and transported, and flange-like retention means extending outwardly of said container adjacent said bottom;

said pallet having a substantially horizontal frame section receiving said container bottom thereon in supporting relation, leg means appropriately spaced on the underside of said frame section and supporting said frame section and said container in a raised position, said leg means providing horizontal and vertical clearance under said frame section for suitable lifting and transporting means such as the forks of a forklift to extend thereunder and lift said storage mechanism and any goods therein, said pallet further having raised lip-like means formed on said frame section and extending in spaced relation about said container horizontally above said retention means but vertically clear thereof so as to permit said container to be moved vertically onto and from said pallet when said shock absorbent resilient securing means are not in place, said lip-like means cooperating with said retention means to define keyway-like spaces extending substantially horizontally about said container;

said shock absorbent resilient securing means being resilient key means made of lengths of hoses or the like and received in said keyway-like spaces after said container is placed on said pallet frame section in supporting relation, said shock absorbent resilient securing means being in shock absorbing resilient engaging relation with said container and said pallet raised lip-like means and sufficiently filling said keyway-like spaces to cooperate with said lip-like means and said flange-like retention means to resiliently but positively lock said pallet and said container together to provide the transportable storage mechanism;

said pallet raised lip-like means having at least one discontinuous section permitting insertion and removal of said shock absorbent resilient securing means into, and from said keyway-like spaces.

5. A storage container and pallet assembly having a shock isolation arrangement for protecting and reducing damage to said container, said assembly comprising:

a storage container having a substantially horizontal bottom section and substantially vertical side sections cooperating to define a generally rectangular container adapted to hold goods to e stored and to be moved and transported by machines such as forklifts and the like, said rectangular storage container having retaining ledge means extending generally horizontally outward therefrom in the vicinity of said bottom wall, said retaining ledge means being located at least on either side of and adjacent to each corner of said container;

a pallet formed as a rectangular frame having pallet support mean extending downwardly from the underside thereof to support said frame with sufficient clearance to accommodate the forks of a forklift and the like, said pallet further having upwardly extending flange means at each corner of said rectangular frame with the upper edges thereof extending inwardly of said frame, said flange means being discontinuous about said frame to provide at least one entry gap between any two adjacent corners of said frame;

said storage container being received on said pallet with its bottom section supported by said frame within said upwardly extending flange means; said storage container retaining ledge means and said flange means being so aligned as to permit vertical movement of said container relative to said pallet and cooperatively providing lock channel means defined by said container side wall sections, said retaining ledge means and said flange means, said flange means inwardly extending upper edges being higher than said retaining ledge means;

and resilient flexible locking and shock absorbing members formed into lengths which are inserted through said entry gaps and received in said lock channel means and engaging said pallet and said container adjacent each corner, said members absorbing horizontal plane shock imparted to said pallet and also locking said container and said pallet together into an assembly, said members being removable through said entry gaps for replacement and to permit separation of said container and said pallet.

* * * * *